US007712749B2

(12) United States Patent
Moon

(10) Patent No.: US 7,712,749 B2
(45) Date of Patent: May 11, 2010

(54) FOOTWEAR

(76) Inventor: Duk-Ki Moon, 416-901 Wolsan Maeul Booyoung Apt., 880-3, Bugok-ri, Jangyu-myeon, Gimhae-si, Gyeongsangnam-do (KR) 621-716

( * ) Notice: Subject to any disclaimer, the term of this patent is extended or adjusted under 35 U.S.C. 154(b) by 92 days.

(21) Appl. No.: 11/866,048

(22) Filed: Oct. 2, 2007

(65) Prior Publication Data

US 2009/0019733 A1 Jan. 22, 2009

(30) Foreign Application Priority Data

Jul. 19, 2007 (KR) ..... 10-2007-0071988

(51) Int. Cl.
*A63C 17/20* (2006.01)

(52) U.S. Cl. ..... 280/11.19; 280/11.3; 280/11.224

(58) Field of Classification Search ..... 280/11.224, 280/11.3, 14.22, 14.24, 612, 611, 613, 11.19, 280/11.223, 11.24, 11.25, 11.27; 441/65, 441/70, 74

See application file for complete search history.

(56) References Cited

U.S. PATENT DOCUMENTS 2,165,581 A * 7/1939 Schroeder ..... 280/11.209
2,547,796 A * 4/1951 Swensson ..... 280/11.28
3,306,623 A * 2/1967 Weitzner ..... 280/11.206
3,963,251 A * 6/1976 Miano ..... 280/843
5,711,539 A 1/1998 Tang
6,331,007 B1 * 12/2001 Bryce ..... 280/11.3
6,409,191 B1 * 6/2002 Wang et al. ..... 280/87.041
6,764,082 B2 * 7/2004 Roderick ..... 280/11.223
7,338,067 B2 * 3/2008 Flaig ..... 280/611
2002/0084600 A1 * 7/2002 Bouldes, Jr. ..... 280/11.19
2003/0094788 A1 * 5/2003 Jacobs ..... 280/612

FOREIGN PATENT DOCUMENTS

KR 2019930017830 8/1993
KR 200378784 3/2005

* cited by examiner

*Primary Examiner*—Glenn Dayoan
*Assistant Examiner*—Vaughn T Coolman
(74) *Attorney, Agent, or Firm*—Rabin & Berdo, P.C.

(57) ABSTRACT

A footwear includes a main shoe body provided with a recess on a bottom thereof; an upper body fixed to the recess and having a plurality of magnets arranged at intervals in a circumferential direction; a lower body having a plurality of magnets arranged at intervals in a circumferential direction, and connected with the upper body to be rotatable relative to the upper body; and rollers mounted to the lower body. The magnets of the upper body and the lower body are arranged so as to return the rollers always to a regular position by magnetism acting between the magnets of the upper body and the magnets of the lower body.

15 Claims, 7 Drawing Sheets

FOOTWEAR

CROSS-REFERENCE TO RELATED APPLICATIONS

This application claims benefit under 35 U.S.C.§119(a) of Korean Patent Application No. 2007-0071988, filed on Jul. 19, 2007 in the Korean Intellectual Property Office, the entire contents of which are incorporated herein by reference.

BACKGROUND OF THE INVENTION

1. Field of the Invention

The present invention relates to footwear equipped with rollers in a bottom thereof.

2. Description of the Related Art

With the recent increase of leisure activities, roller skating using roller skate shoes such as roller skates, roller blades and inline skates are becoming popular. Generally, such roller skate shoes dedicatedly include a roller assembly at their bottoms. Therefore, in order to enjoy roller skating, a rider has to carry the roller skate shoes to a predetermined place and change his/her walking shoes into the roller skate shoes. After enjoying the roller skating, the rider now has to change back to the walking shoes. These processes are bothersome for the rider.

Nowadays, a variety of shoes equipped with rollers are being introduced to overcome such bother. A conventional roller shoe is disclosed in KR Utility Model No. 20-0378784 registered on May 3, 2005.

The conventional roller shoe is shown in FIG. 1 (corresponding to FIG. 3 in the publication). Since rollers 400 of the conventional roller shoe are rotatable by 360°, the rider can make a turn by 360°. However, in the conventional roller shoe, the rollers 400 cannot automatically return to the initial position after the turning.

Thus, the rollers 400 are often displaced from the initial position. When the rider starts in this state, the rider may even fall down because the rollers 400 would not roll smoothly and promptly due to resistance against the ground surface.

SUMMARY OF THE INVENTION

Therefore, the present invention has been made in view of the above-mentioned problems, and it is an aspect of the present invention to provide footwear enabling a rider to enjoy roller skating more safely and briskly, by having a function of returning rollers thereof automatically to their initial position.

In order to achieve the above-described aspects of the present invention, there is provided footwear comprising a main shoe body provided with a recess on a bottom thereof; an upper body fixed to the recess and having a plurality of magnets arranged at intervals in a circumferential direction; a lower body having a plurality of magnets arranged at intervals in a circumferential direction and connected with the upper body to be rotatable relative to the upper body; and rollers mounted to the lower body, wherein the magnets of the upper body and the lower body are arranged so as to return the rollers always to a regular position by magnetism acting between the magnets of the upper body and the magnets of the lower body.

The upper body and the lower body include four magnets respectively, arranged at constant intervals with alternate polarities.

A first sliding member is installed between the upper body and the lower body.

The first sliding member is a ball bearing.

A bearing cover provided with a ball bearing support groove is mounted to the upper body and the lower body respectively, and the ball bearing is supported by the bearing cover.

The upper body-and the lower body include a through-hole, respectively, and a screw member penetrates the through-hole of the lower body and is screw-connected with the through-hole of the upper body.

A second sliding member is mounted between a head of the screw member and the lower body.

The second sliding member is a ball bearing.

The lower body further includes a bearing cover having a ball bearing support groove, and the ball bearing is supported by the bearing cover of the lower body and another bearing cover having a ball bearing support groove.

The lower body includes twos roller recesses, and a roller rotation shaft support recess for a supporting rotation shaft of the rollers is formed on opposite sides of the respective roller recesses.

The lower body includes a separation prevention plate preventing separation of the rollers and having a window for allowing a body part of the rollers to pass through.

The recess is disposed at a rear side of the bottom, and two rows of rollers are additionally mounted to a front side of the bottom, the two rows of which a front row comprises two rollers and a rear row comprises one roller.

BRIEF DESCRIPTION OF THE DRAWING FIGURES

The above aspect and other features of the present invention will become more apparent by describing in detail exemplary embodiments thereof with reference to the attached drawing figures, wherein;

FIG. 6(*b*) shows rollers of the footwear of FIG. 2 as displaced from the initial position.

DETAILED DESCRIPTION OF THE EXEMPLARY EMBODIMENTS

Figure 1:
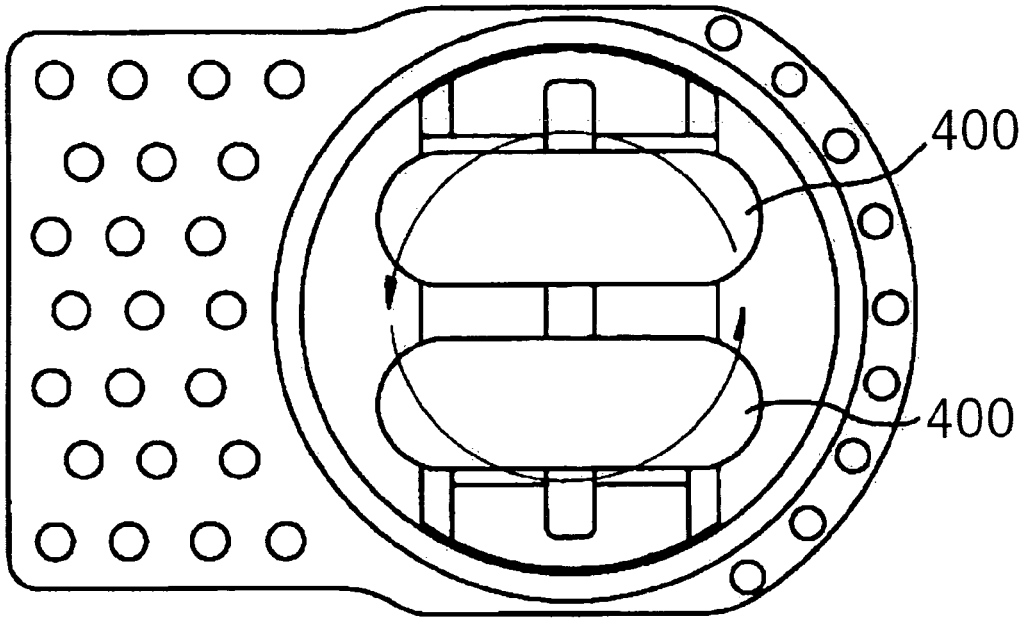
FIG. 1 PRIOR ART
FIG. 1 shows main parts of a bottom of a conventional roller shoe.

Hereinafter, an exemplary embodiment of the present invention will be described in detail with reference to the accompanying drawing figures.

The matters defined in the description such as a detailed construction and elements are nothing but the ones provided to assist in a comprehensive understanding of the invention. Thus, it is apparent that the present invention can be carried out without those defined matters.

As shown in FIGS. 2 through 5, footwear according to the embodiment of the present invention comprises a main shoe body 1, an upper body 2, a lower body 3, and rollers 8.

The main shoe body 1 has a recess 12 on a bottom 11 thereof. The recess 12 is disposed corresponding to a, heel.

Figure 5:
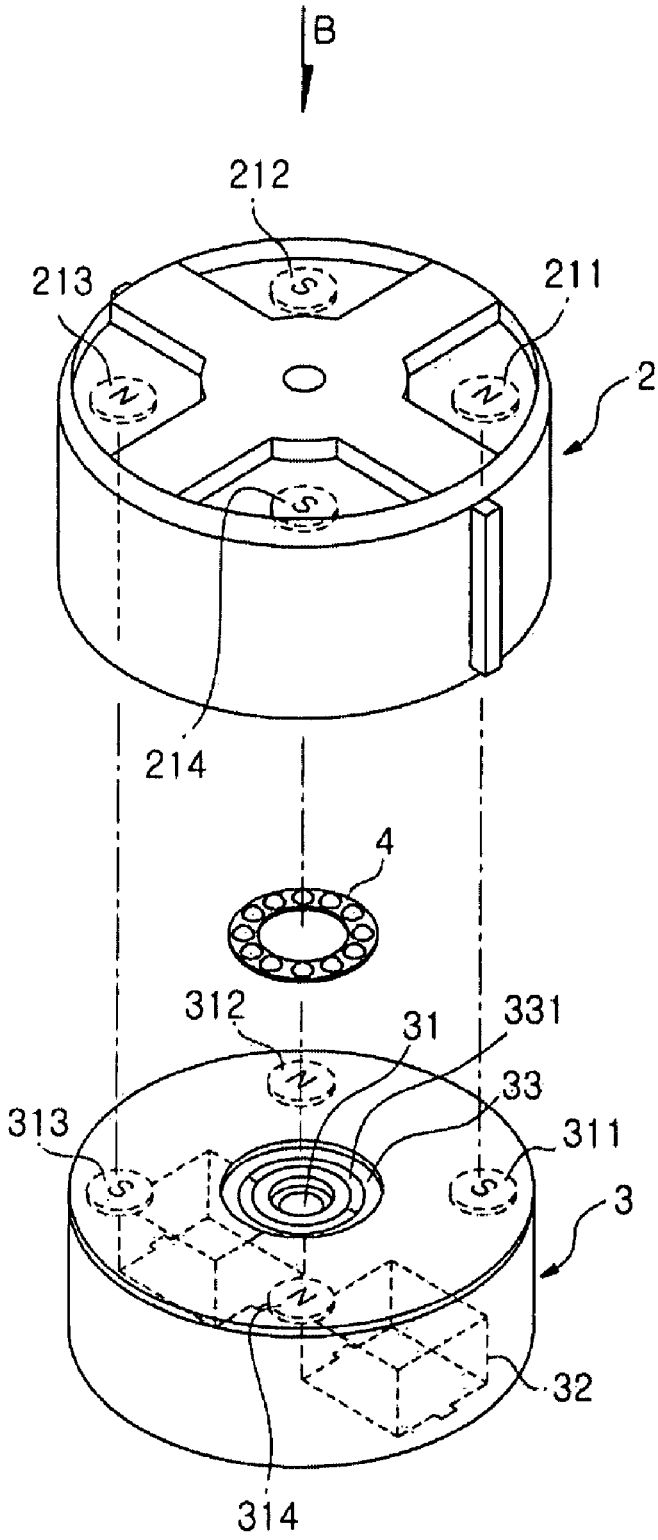
FIG. 5 is an exploded view of an upper body and a lower body of the footwear of FIG. 4, as seen from another direction.

The upper body 2 is fixed in the recess 12. Referring to FIG. 5, four magnets 211, 212, 213 and 214 are mounted in the upper body 2, being arranged at almost constant intervals in a circumferential direction. More specifically, the four magnets 211, 212, 213 and 214 are arranged at approximately 90.degree. intervals to alternately have opposite polarities, that is, in the order of N-S-N-S. Here, N denotes a positive pole and S denotes a negative pole.

In the same manner as the upper body 2, the lower body 3 is also provided with four magnets 311, 312, 313 and 314 which are circumferentially arranged at almost constant intervals with alternate polarities. For convenient explanation, the polarities of magnets in the specification and the drawings are designated to correspond between the facing magnets. For example, the magnet 212 in FIG. 5 has the negative pole S on the surface facing the magnet 312, and the magnet 312 has the positive pole N on the surface facing the magnet 212.

Additionally, a roller recess 32, is formed on a bottom surface of the lower body 3. Two roller recesses 32 are provided according to this embodiment. The lower body 3 is magnetically connected to the upper body 2, being rotatable with respect to the upper body 2. According to this, the magnets 311, 312, 313 and 314 of the lower body 3 are coupled with the magnets 211, 212, 213 and 214 of the upper body 2 to match with opposite polarities, as shown in FIG. 5.

According to the exemplary embodiment, the upper body 2 and the lower body 3 are provided with a first sliding member such as a ball bearing 4 disposed therebetween, for smooth rotation relative to each other. For this, the upper body 2 and the lower body 3 have bearing covers 22 and 33 including ball bearing support grooves 221 and 331, respectively. The, ball bearing 4 is supported by the bearing covers 22 and 33.

In addition, the upper body 2 and the lower body 3 have through-holes 21 and 31 respectively, penetrating the centers thereof. The upper body 2 and the lower body 3 can be connected not to separate from each other by a screw member 5 penetrating the through-holes 21 and 31. While the through-hole 21 includes a female screw thread, the through-hole 31 does not. Therefore, the screw member 5 is fixedly connected only to the upper body 2 through screw-connection between the through-hole 21 and a male screw thread formed around an end thereof. In other words, the lower body 3 is rotatable relative to the screw member 5.

For smooth rotation between the upper and lower bodies 2 and 3, it is preferred that a second sliding member such as a ball bearing 6 is installed between a head of the screw member 5 and the lower body 3. The lower body 3 has a bearing cover 34 including a ball bearing support groove 341. The ball bearing 6 is supported by another bearing cover 7 and the bearing cover 34 having the ball bearing support groove 341.

Figure 4:
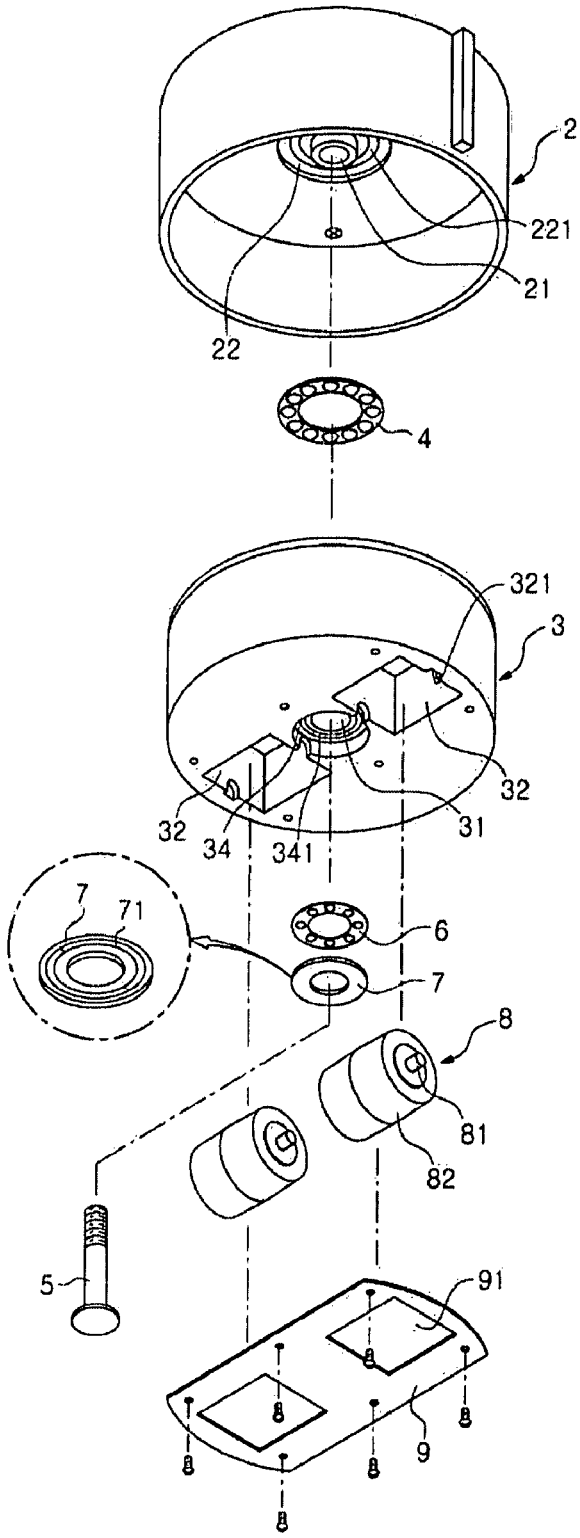
FIG. 4 is an exploded view showing main parts of the footwear of FIG. 2.

As shown in FIG. 4, the rollers 8 are mounted rotatably in the roller recess 32. A roller rotation shaft support recess 321 for supporting a roller rotation shaft 81 is formed on opposite sides of the respective roller recesses 32. It is preferred that diameter of the rollers 8 is not greater than 16 mm to effectively restrain generation of noise during roller skating.

In order for efficient stop using skidproof protrusions 100 and 101 during the roller skating, a protruded degree of the rollers 8 from the roller recess 32 is preferably less than about 8 mm.

A separation, preventive plate 9 is mounted to the lower body 3 to prevent separation of the rollers 8. The separation preventive plate 9 has two windows 91 for the two rollers 8 to protrude through. The window 91 is sized to allow only a body part 82 of the rollers 8 but not the rotation shaft 81.

Figure 2:
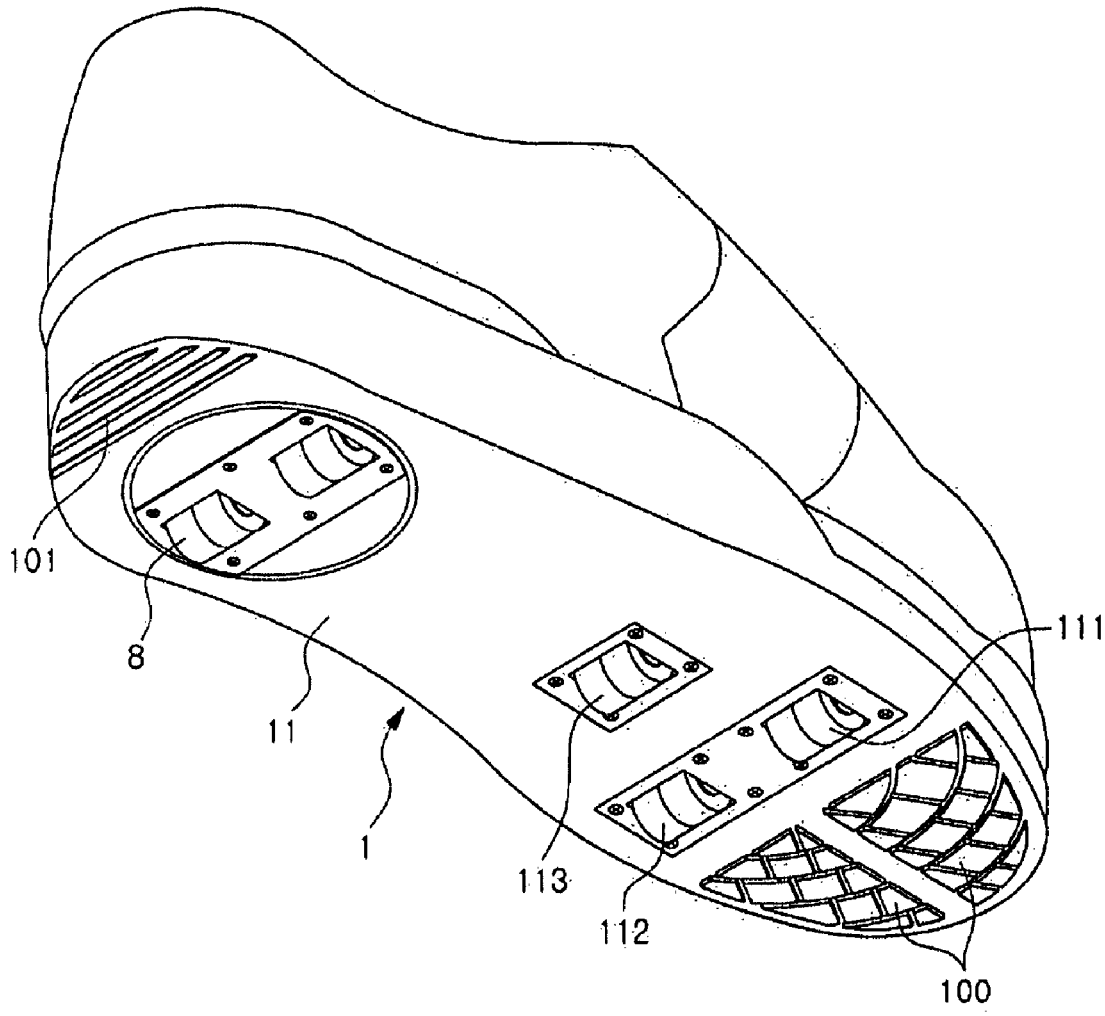
FIG. 2 is a perspective view of a bottom of footwear according to an embodiment of the present invention.
Figure 3:
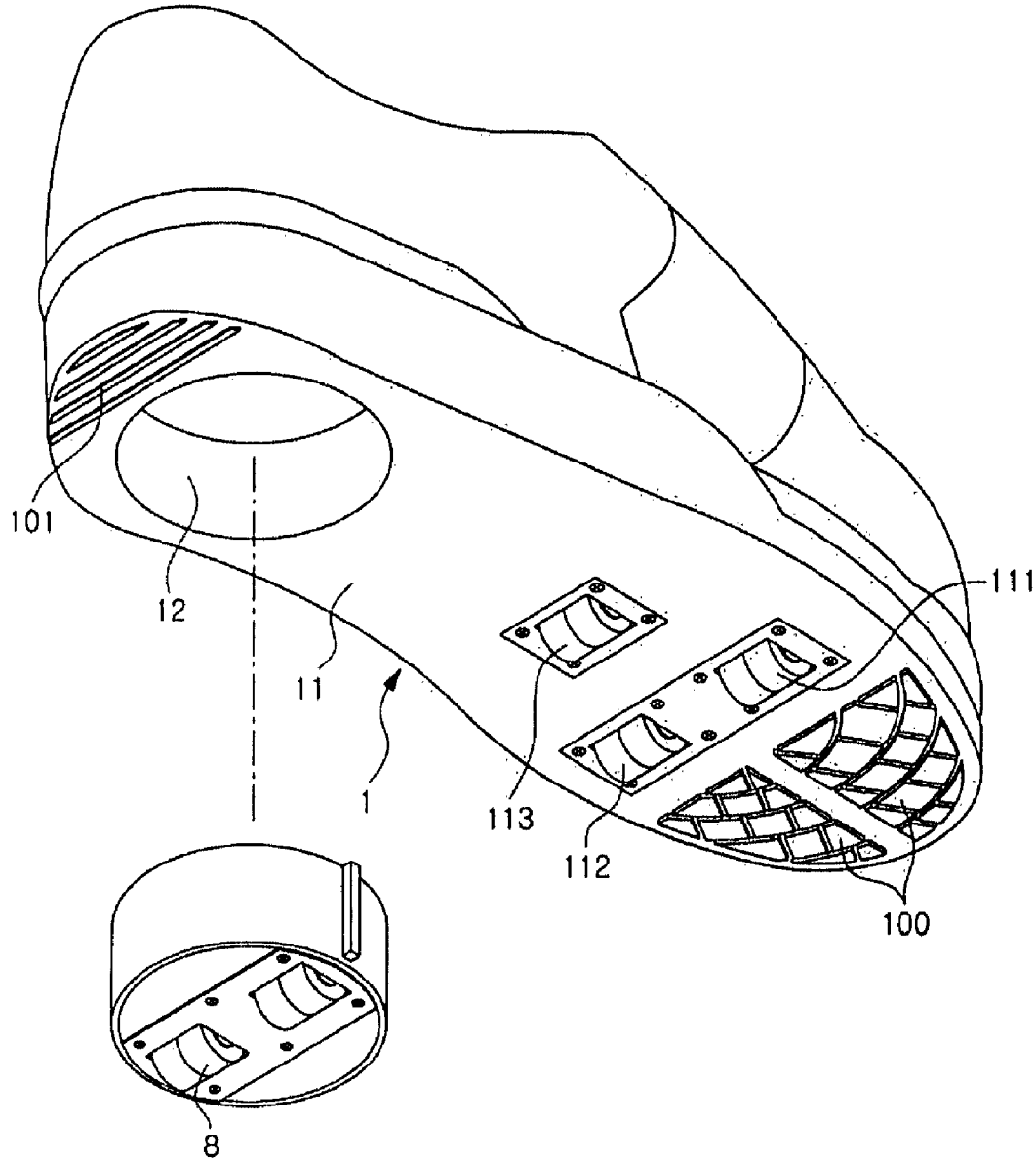
FIG. 3 is an exploded view of the footwear shown in FIG. 2.

Referring to FIG. 2, two rows of rollers are further mounted to a front side of the bottom 11 of the footwear. A front row of the two rows includes two rollers 111 and 112, and a rear row does one roller 113. Preferably, the rollers 111 and 112 of the front row and the roller 113 of the rear row are arranged almost in the middle of the width of the bottom 11.

The skidproof protrusions 100 and 101 are formed on front and rear ends of the bottom 11 so that the rider can stop by tilting the footwear forward or backward during roller skating.

The operation of the above-structured footwear will now be described with reference to FIGS. 6 and 7.

Figure 7:
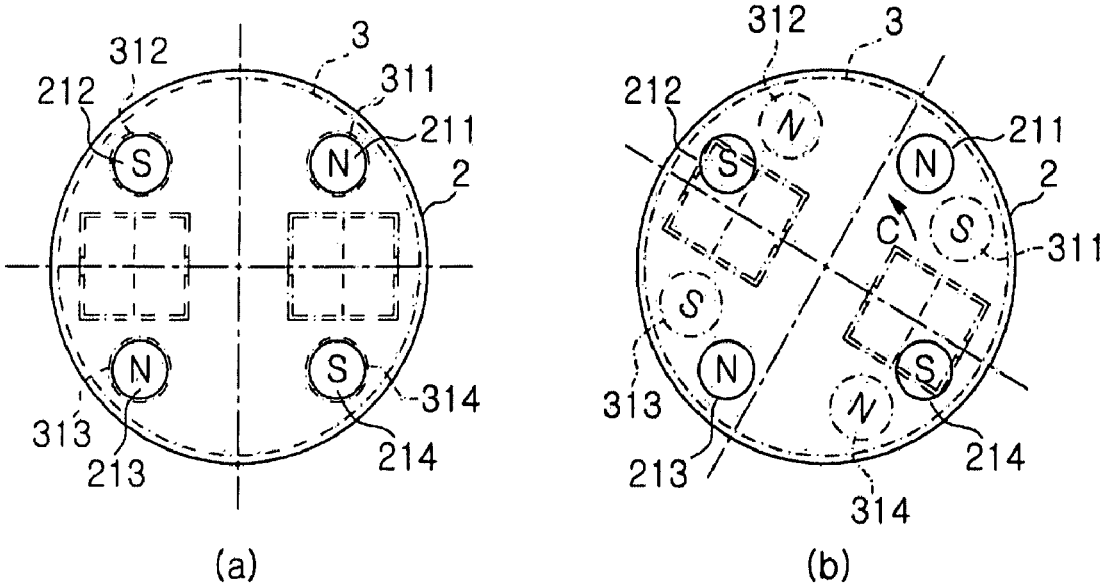
FIG. 7 is a view-for-explaining the operation of the footwear of FIG. 2.

FIG. 7 is a view for explaining the relative operations of the upper body 2 and the lower body 3, as seen in an arrowed direction B of FIG. 5. More particularly, FIG. 7(*a*) shows the lower body 3 placed in the initial position while FIG. 7(*b*) shows the lower body 3 as rotated by about 30° clockwise from the initial position. For convenience in explanation, the upper body 2 and its magnets 211, 212, 213 and 214 are indicated by a solid line and the lower body 3 and its magnets 311, 312, 313 and 314 by a dotted line.

In the initial position as shown in FIG. 7(*a*), the lower body 3 and the upper body 2 are connected with each other magnetically. In other Words, the four magnets 211, 212, 213 and 214 of the upper body 2 are magnetically coupled with the magnets 311, 312, 313 and 314 of the lower body 3, respectively.

Figure 6:
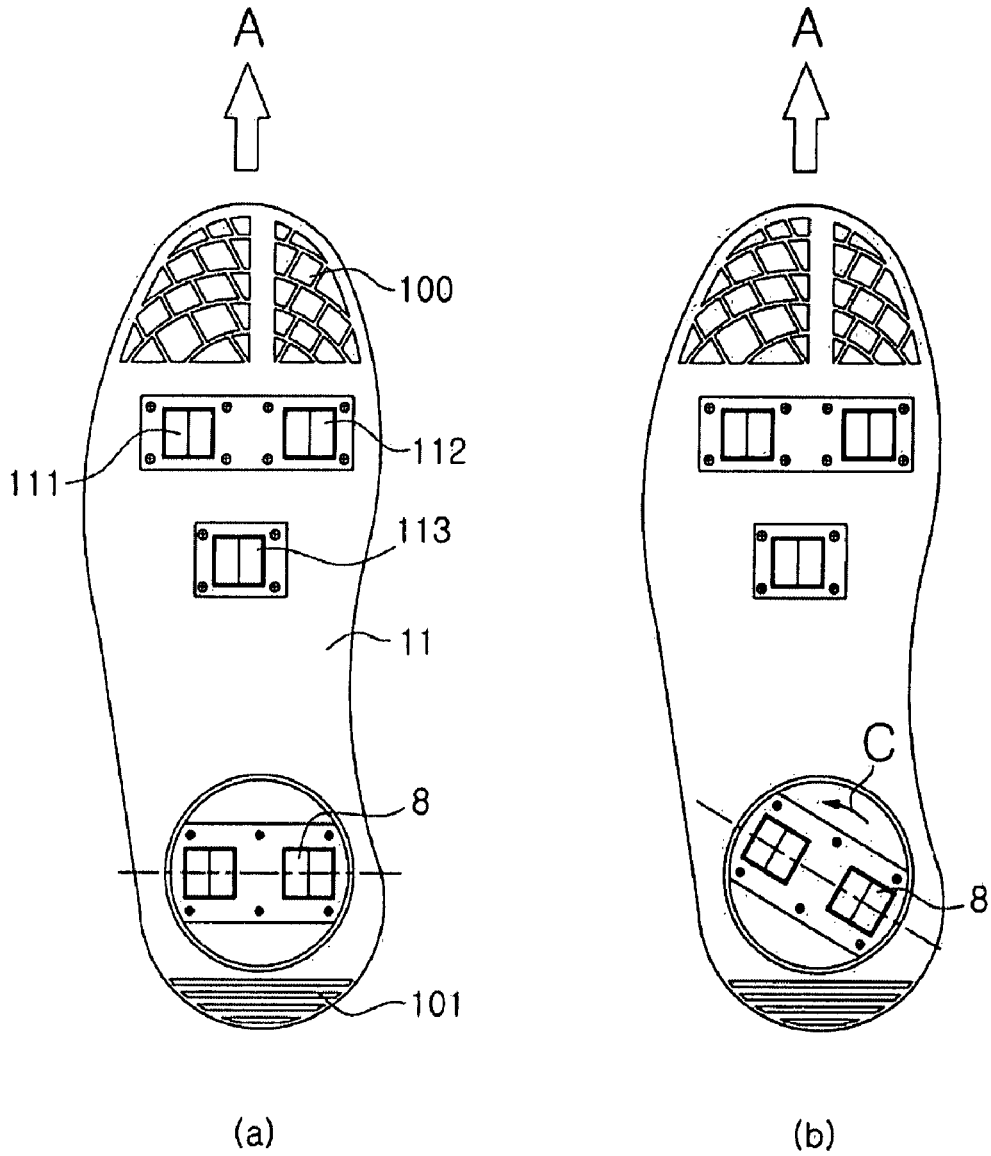
FIG. 6(*a*) shows rollers of the footwear of FIG. 2 as placed in the initial position.

When changing the skating direction with the footwear in contact with the ground surface, the lower body 3 is turned by a predetermined angle, for example, by about 30° clockwise as shown in FIG. 6(*b*) and FIG. 7(*b*).

After the turn, when the rollers 8 are separated from the ground surface by lifting a heel of the footwear slightly away from the ground surface, the lower body 3 is automatically rotated in an arrowed direction C due to magnetism, thereby returning to the initial position as shown in FIG. 6(*a*) and FIG. 7(*a*). More specifically, the lower body 3 is returned to the initial position by the magnetism acting respectively between the magnets 211 and 311, the magnets 212 and 312, the magnets 213 and 313, and the magnets 214 and 314.

Now, the rider can keep roller skating, putting the heel down back to the ground.

Since the lower body 3 can automatically return to the initial position in this way, the rollers 8 are placed always in a regular position (FIG. 6(*a*)). In other words, after the turn, simply by lifting the heel of the footwear away from the ground surface, the rider can return the rollers 8 to the regular position, that is, to head in an advancing direction 'A'.

For stop in the middle of the roller skating, on the other hand, the rider tilts the roll footwear er shoe so that the skidproof protrusions 100 and 101 are contacted with the ground surface.

Here, the roller diameter not greater than 16 mm is advantageous in restraining generation of noise during the roller skating. Also, the interval not greater than 8 mm between the ground surface and the shoe bottom helps smooth stop.

Although the respectively four magnets are provided to the upper body 2 and the lower body 3 with alternate polarities in this embodiment, the present invention is not limited to this configuration. For example, two magnets may be mounted to the upper body 2 in the order of N-S, while another two magnets are mounted to the lower body 3 in the opposite order, that is, in the order of S-N.

Alternatively, the upper body 2 may be mounted with six magnets arranged in the order of N-S-S-N-S-S and the lower body 3 in the order of S-N-N-S-N-N.

As described above, the present-invention is not limited to certain configuration but may adopt other various configurations as long as it can keep the rollers 8 in the regular position by applying the magnetic coupling, between the upper body 2 and the lower body 3.

With the footwear according to the embodiment of the present invention, the rollers can immediately return to their initial positions from any displaced position, thereby enabling more prompt and safe roller skating. Furthermore, the rollers are able to turn by 360° without a turning radius. In addition, since respectively five rollers are provided at proper places of the shoe bottom, the rider can feel almost the same wearing comfort as general walking shoes and enjoy roller skating stably and safely.

While the invention has been shown and described with reference to certain embodiments thereof, it will be understood by those skilled in the art that various changes in form and details may be made therein without departing from the spirit and scope of the invention as defined by the appended claims.

What is claimed is:

1. Footwear comprising:

a main shoe body provided with a recess on a bottom thereof;

an upper body fixed to the recess and having a first plurality of magnets arranged at intervals in a circumferential direction;

a lower body having a second plurality of magnets arranged at intervals in a circumferential direction, and rotatably connected with the upper body, such that the lower body is rotatable relative to the upper body while the lower body maintains a connection with the upper body, wherein said connection prevents vertical displacement between the upper body and the lower body; and rollers mounted to the lower body, wherein the first plurality of magnets of the upper body and the second plurality of magnets of the lower body are arranged so as to rotate the lower body to an initial position in which the second plurality of magnets are magnetically connected with the first plurality of magnets, from a different position in which the lower body is rotated from the initial position, by magnetism acting between the first plurality of magnets of the upper body and the second plurality of magnets of the lower body.

2. The footwear of claim 1, wherein the upper body and the lower body include four magnets respectively, arranged at constant intervals with alternate polarities.

3. The footwear of claim 1, wherein the recess is disposed at a rear side of the bottom, and two rows of rollers are additionally mounted to a front side of the bottom, the two rows of which a front row comprises two rollers and a rear row comprises one roller.

4. The footwear of claim 1, wherein the lower body is rotatable relative to the upper body in the circumferential direction.

5. The footwear of claim 1, wherein:

the lower body is rotated from the initial position to the different position when a skating direction of the footwear is changed while the rollers are in contact with a ground surface; and the lower body is rotated from the different position to the initial position by the magnetism when the rollers are separated from the ground surface.

6. The footwear of claim 1, wherein the lower body includes two roller recesses, and a roller rotation shaft support recess for supporting a rotation shaft of the rollers is formed on opposite sides of the respective roller recesses.

7. The footwear of claim 6, wherein the lower body includes a separation prevention plate preventing separation of the rollers and having a window for allowing a body part of the rollers to pass through.

8. Footwear comprising:

a main shoe body provided with a recess on a bottom thereof;

an upper body fixed to the recess and having a first plurality of magnets arranged at intervals in a circumferential direction;

a lower body having a second plurality of magnets arranged at intervals in a circumferential direction, and connected with the upper body to be rotatable relative to the upper body, wherein said connection prevents vertical displacement between the upper body and the lower body; and rollers mounted to the lower body, wherein the first plurality of magnets of the upper body and the second plurality of magnets of the lower body are arranged so as to return the rollers always to a regular position in which the second plurality of magnets are magnetically connected with the first plurality of magnets, from a different position in which the lower body is rotated from the regular position by magnetism acting between the first plurality of magnets of the upper body and the second plurality of magnets of the lower body, wherein the upper body and the lower body include four magnets respectively, arranged at constant intervals with alternate polarities.

9. The footwear of claim 8, wherein a first sliding member is installed between the upper body and the lower body.

10. The footwear of claim 9, wherein the first sliding member is a ball bearing.

11. The footwear of claim 10, wherein a bearing cover having a ball bearing support groove is mounted to the upper body and the lower body respectively, and the ball bearing is supported by the bearing covers of the upper body and the lower body.

12. Footwear comprising:

a main shoe body provided with a recess on a bottom thereof;

an upper body fixed to the recess and having a first plurality of magnets arranged at intervals in a circumferential direction;

a lower body having a second plurality of magnets arranged at intervals in a circumferential direction, and connected with the upper body to be rotatable relative to the upper body; and rollers mounted to the lower body, wherein the first plurality of magnets of the upper body and the second plurality of magnets of the lower body are arranged so as to return the rollers always to a regular position in which the second plurality of magnets are magnetically connected with the first plurality of magnets, from a different position in which the lower body is rotated from the regular position by magnetism acting between the first plurality of magnets of the upper body and the second plurality of magnets of the lower body, and wherein the upper body and the lower body include a through-hole, respectively, and a screw member penetrates the through-hole of the lower body and is screw-connected with the through-hole of the upper body.

13. The footwear of claim 12, wherein a sliding member is mounted between a head of the screw member and the lower body.

14. The footwear of claim 13, wherein a sliding member is a ball bearing.

15. The footwear of claim 14, wherein the lower body further includes a bearing. cover having a ball bearing support groove, and the ball bearing is supported by the bearing cover of the lower body and, another bearing cover having a ball bearing support groove.

* * * * *